US010051964B2

(12) United States Patent
Ma

(10) Patent No.: US 10,051,964 B2
(45) Date of Patent: Aug. 21, 2018

(54) ASSEMBLED CHAIR

(71) Applicant: Hung Trien Ma, City of Industry, CA (US)

(72) Inventor: Hung Trien Ma, City of Industry, CA (US)

( * ) Notice: Subject to any disclaimer, the term of this patent is extended or adjusted under 35 U.S.C. 154(b) by 0 days.

(21) Appl. No.: 15/467,266

(22) Filed: Mar. 23, 2017

(65) Prior Publication Data

US 2018/0168353 A1 Jun. 21, 2018

(30) Foreign Application Priority Data

Dec. 15, 2016 (CN) ..... 2016 2 1381623 U

(51) Int. Cl.

| | |
|---|---|
| ***A47C 7/02*** | (2006.01) |
| ***B60N 2/68*** | (2006.01) |
| ***A47C 1/024*** | (2006.01) |
| ***A47C 7/38*** | (2006.01) |
| ***A47C 7/24*** | (2006.01) |

(52) U.S. Cl.

CPC ..... *A47C 1/024* (2013.01); *A47C 7/24* (2013.01); *A47C 7/38* (2013.01)

(58) Field of Classification Search

CPC ..... A47C 1/024; A47C 7/38; A47C 7/24

USPC ..... 297/440.16

See application file for complete search history.

(56) References Cited

U.S. PATENT DOCUMENTS 3,989,298 A * 11/1976 Cycowicz ..... A47C 4/02 297/440.21 X
4,588,228 A * 5/1986 Nemoto ..... A47C 7/40 297/452.18
5,005,908 A * 4/1991 Young ..... A47C 7/40 24/653
5,123,706 A * 6/1992 Granzow ..... B60N 2/68 297/362.11
5,135,284 A * 8/1992 Crum ..... A47C 7/42 297/440.15
5,184,871 A * 2/1993 Lapointe ..... A47C 4/02 297/440.21
5,240,310 A * 8/1993 Rink ..... B60N 2/686 248/429
5,253,923 A * 10/1993 Gootee ..... A47C 7/40 297/440.1
5,269,589 A * 12/1993 Brothers ..... A47C 7/42 297/440.16
5,690,386 A * 11/1997 Chabanne ..... B60N 2/688 297/367 R
5,711,577 A * 1/1998 Whalen ..... B60N 2/688 297/361.1

(Continued)

*Primary Examiner* — Rodney B White

(74) *Attorney, Agent, or Firm* — Muncy, Geissler, Olds & Lowe, P.C.

(57) ABSTRACT

An assembled chair includes a chair seat, a chair back, two connectors, two fixing sleeves and two protection cases. The two connectors respectively have two connection portions. The two fixing sleeves are respectively arranged at two opposite sides of the chair back. The two protection cases are respectively fixed at two opposite sides of the chair seat, and the two connectors are respectively arranged in the two protection cases, and the two connection portions emerges from the two protection cases, and the two fixing sleeves respectively sleeve the two connection portions, and at least two fixing members are respectively fixed to the two connection portions, so as to fix the chair back to the chair seat.

12 Claims, 9 Drawing Sheets

(56) References Cited

U.S. PATENT DOCUMENTS

| | | | | | |
|---|---|---|---|---|---|
| 5,795,024 | A * | 8/1998 | Collins | B60N 2/23 | 297/361.1 |
| 5,826,944 | A * | 10/1998 | Beneker | B60N 2/68 | 297/440.2 |
| RE37,026 | E * | 1/2001 | Whalen | B60N 2/688 | 297/361.1 |
| 6,322,148 | B1 * | 11/2001 | Kolena | B60N 2/682 | 297/354.12 |
| 6,543,855 | B2 * | 4/2003 | Bruck | A47C 7/40 | 297/440.16 |
| 6,685,272 | B1 * | 2/2004 | Bonk | B60N 2/23 | 297/440.21 |
| 7,399,036 | B2 * | 7/2008 | Kowal | A47C 4/02 | 297/440.16 |

* cited by examiner

ASSEMBLED CHAIR

This application claims priority for China patent application no. 201621381623.9 filed on Dec. 15, 2016, the content of which is incorporated by reference in its entirely.

BACKGROUND OF THE INVENTION

Field of the Invention

The present invention relates to a chair, particularly to an assembled chair.

Description of the Related Art

Chairs are furniture, which has found application in many areas, such as houses, offices or public places. Although the chairs have different appearance, the chairs can provide comfortable sitting space for people.

For example, a chair comprises a chair seat. The chair seat comprises a seat body, a seat cushion and a chair back. The seat body comprises a horizontal frame, a front supporting leg and two back supporting legs. The horizontal frame is horizontally arranged. The front supporting leg is arranged at a front end of the horizontal frame. The back supporting legs are arranged at two sides of a rear end of the horizontal frame. The backs of the back supporting legs are level. The seat cushion is fixed on the horizontal frame. The chair back comprises a chair back frame and a chair back cushion. The chair back cushion is fixed to two sides of the chair back frame. The chair back frame comprises two side rods and an upper horizontal rod. The side rods are respectively fixed to two sides of the rear end of the horizontal frame. The upper horizontal rod is connected between upper ends of the side rods. Since the chair back frame is usually too heavy and too large, the chair back frame is difficulty installed on the seat body using the side rods. Besides, all the assembled structures are exposed to affect the appearance and safety of the chair. As shown in FIG. 1 and FIG. 2, a chair 10, a connector 12, angle regulators 14 and a seat cushion 16 are shown. The connector 12 is fixed to a chair back. The seat cushion 16 comprises a buffer layer 161 and a surface material layer 162. The seat cushion 16 directly wraps a part of the connector 12 and the angle regulators 14. As shown in FIG. 2, when the angle regulators 14 rotate the connector 12, the connector 12 will destroy the seat cushion 16.

To overcome the abovementioned problems, the present invention provides an assembled chair, so as to solve the afore-mentioned problems of the prior art.

SUMMARY OF THE INVENTION

A primary objective of the present invention is to provide an assembled chair, which uses fixing sleeves to sleeve connectors, so as to form a humanitarian auxiliary design and easily fix a chair back to a chair seat. Besides, the connector is wrapped in a protection case lest the connector touch a seat cushion to affect safety.

To achieve the abovementioned objectives, the present invention provides an assembled chair, which comprises a chair seat, a chair back, two connectors, two fixing sleeves, two protection cases, two angle regulators, a seat cushion, a back cushion, a pillow frame, at least two first hollow fixing sleeves and at least two second hollow fixing sleeves, wherein the fixing sleeve and the chair back are two independent elements or are integrally formed as a piece. The two connectors respectively have two connection portions.

The two fixing sleeves are respectively arranged at two opposite sides of the chair back. The two protection cases are respectively fixed at two opposite sides of the chair seat. The two connectors are respectively arranged in the two protection cases, and the two connection portions emerges from the two protection cases, and the two fixing sleeves respectively sleeve the two connection portions, and at least two fixing members are respectively fixed to the two connection portions, so as to fix the chair back to the chair seat. For example, the two fixing members are screws or bolts. The two angle regulators are respectively arranged in the two protection cases and respectively connected with the two connectors, and the two angle regulators regulate an angle of the chair back with respect to the chair seat through the two connectors and the two fixing sleeves. The pillow frame is arranged on a top of the chair back. The seat cushion is arranged on the chair seat and wraps the chair seat and the two protection cases. The back cushion is arranged on the chair back and wraps the chair back and the pillow frame. Alternatively, the back cushion wraps the fixing sleeves, the chair back and the pillow frame.

Each protection case further comprises two protection subcases fixed to each other, and each connector is fixed between the two protection subcases corresponded thereof. The two connection portions respectively abut against the two fixing sleeves. Alternatively, each connection portion has an upper part and a lower part, and the largest cross-section width of the upper part is less than the largest cross-section width of the lower part corresponded thereof to use the two lower parts to respectively abut against the two fixing sleeves.

Each fixing sleeve is further provided with at least one first hollow fixing sleeve and at least one second hollow fixing sleeve, and the first hollow fixing sleeve and the second hollow fixing sleeve penetrate through the fixing sleeve corresponded thereof, and each fixing member sequentially penetrates through the first hollow fixing sleeve, the connection portion and the second hollow fixing sleeve corresponded thereof, so as to respectively fix the two fixing sleeves to the two connection portions. Each the fixing member further comprises a front fixing portion, a middle fixing portion and a rear fixing portion, and the middle fixing portion is arranged between the front fixing portion and the rear fixing portion, and the largest cross-section diameters of the front fixing portion, the middle fixing portion and the rear fixing portion are sequentially decreased, and the largest cross-section diameters of the middle fixing portion and the rear fixing portion respectively match the largest inner diameters of the second hollow fixing sleeve and the first hollow fixing sleeve, and the rear fixing portion sequentially penetrates through the connection portion and the second hollow fixing sleeve corresponded thereof, and the middle fixing portion penetrates through the first hollow fixing sleeve corresponded thereof, and the front fixing portion is arranged adjacent to the first hollow fixing sleeve corresponded thereof.

Below, the embodiments are described in detail in cooperation with the drawings to make easily understood the technical contents, characteristics and accomplishments of the present invention.

DETAILED DESCRIPTION OF THE INVENTION

Figure 1:
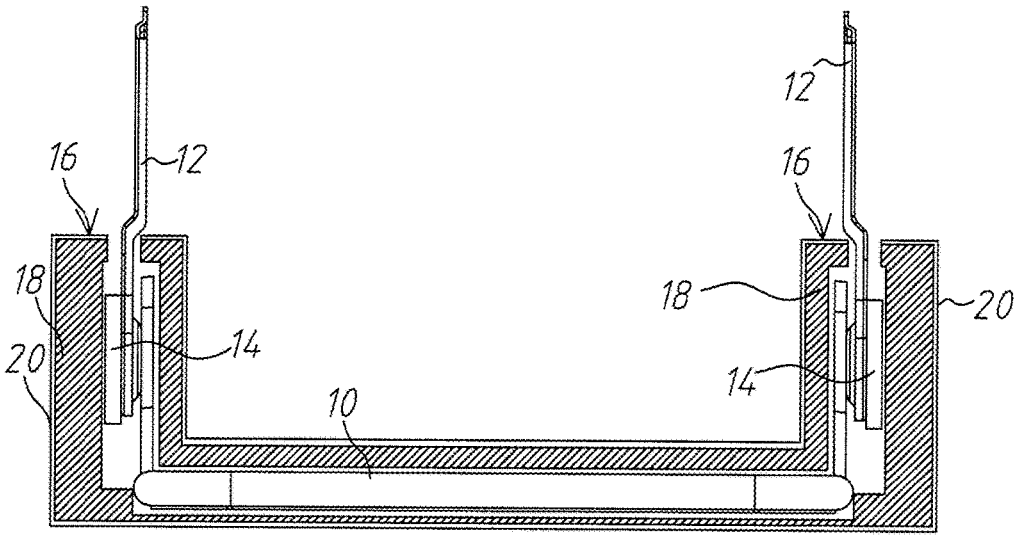
Fig. 1(prior art)
FIG. 1 is a sectional view of a chair seat, connectors, angle regulators and a seat cushion in a conventional technology.
Figure 2:
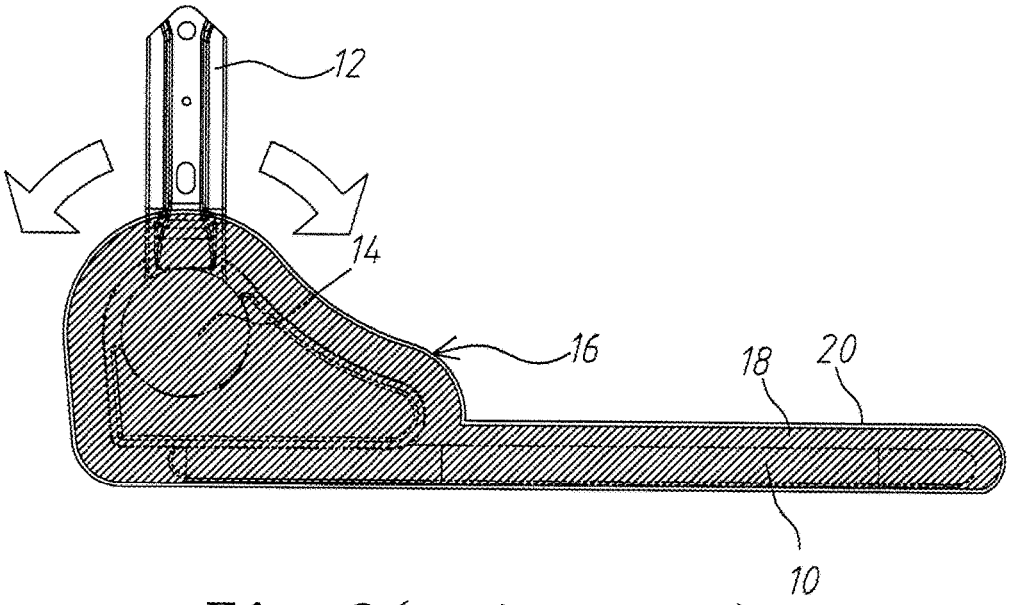
Fig. 2(prior art)
FIG. 2 is a side view of the chair seat, the connectors, the angle regulators and the seat cushion in a conventional technology.
Figure 3:
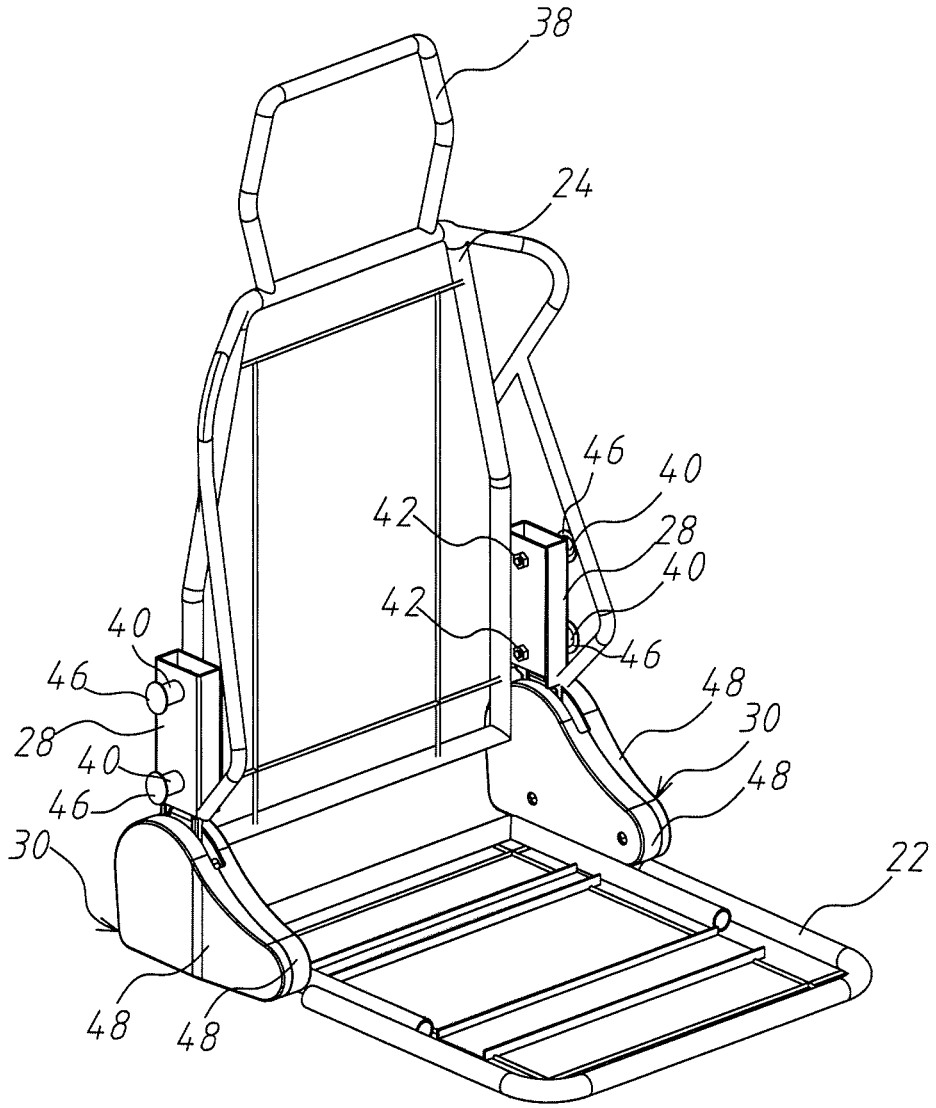
FIG. 3 is a perspective view of an assembled chair according to an embodiment of the present invention.
Figure 4:
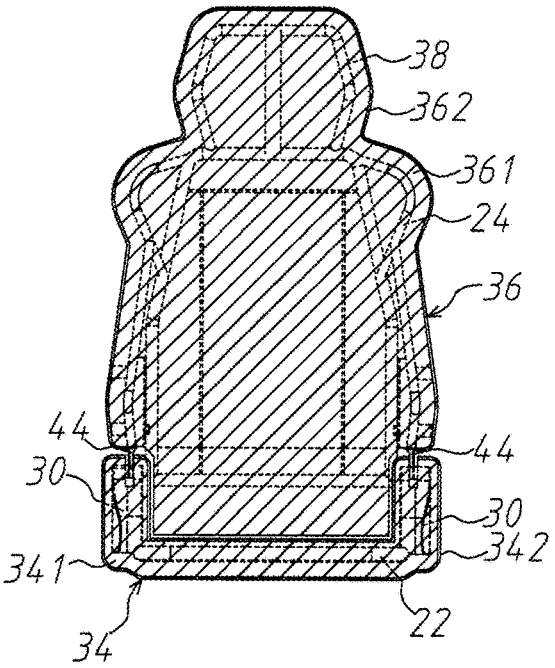
FIG. 4 is a front view of the assembled chair according to an embodiment of the present invention.
Figure 5:
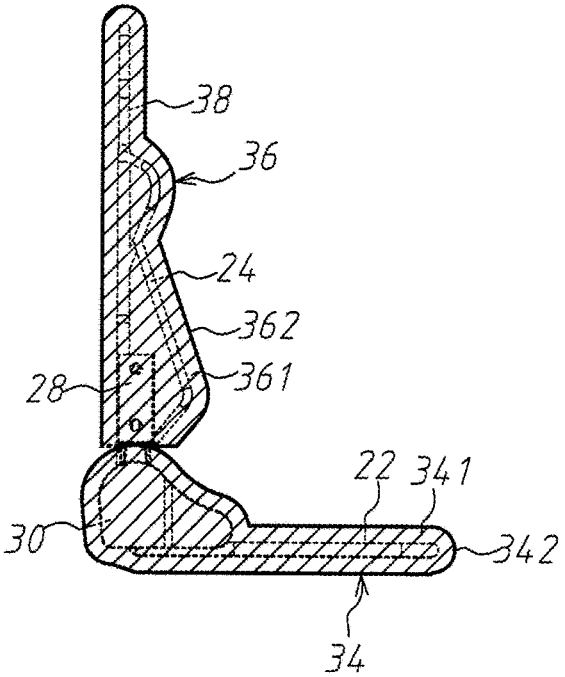
FIG. 5 is a side view of the assembled chair according to an embodiment of the present invention.

Reference will now be made in detail to embodiments illustrated in the accompanying drawings. Wherever possible, the same reference numbers are used in the drawings and the description to refer to the same or like parts. In the drawings, the shape and thickness may be exaggerated for clarity and convenience. This description will be directed in particular to elements forming part of, or cooperating more directly with, methods and apparatus in accordance with the present disclosure. It is to be understood that elements not specifically shown or described may take various forms well known to those skilled in the art. Many alternatives and modifications will be apparent to those skilled in the art, once informed by the present disclosure.

Refer to FIG. 3, FIG. 4, FIG. 5, FIG. 6, FIG. 7, FIG. 8 and FIG. 9 to introduce an assembled chair of the present invention. The assembled chair of the present invention comprises a chair seat 22, a chair back 24, two connectors 26, two fixing sleeves 28, two protection cases 30, two angle regulators 32, a seat cushion 34, a back cushion 36, a pillow frame 38, at least two first hollow fixing sleeves 40 and at least two second hollow fixing sleeves 42, wherein the fixing sleeve 28 and the chair back 24 are two independent elements or are integrally formed as a piece. The seat cushion 34 comprises a first buffer layer 341 and a first surface material layer 342. The back cushion 36 comprises a second buffer layer 361 and a second surface material layer 362. The two connectors 26 respectively have two connection portions 44. The two fixing sleeves 28 are respectively arranged at two opposite sides of the chair back 24. The two protection cases 30 are respectively fixed at two opposite sides of the chair seat 22. The two connectors 26 are respectively arranged in the two protection cases 30, and the two connection portions 44 emerges from the two protection cases 30, and the two fixing sleeves 28 respectively precisely sleeve the two connection portions 44, so as to form a humanitarian auxiliary design. At least two fixing members 46 are respectively fixed to the two connection portions 44, so as to easily fix the chair back 24 to the chair seat 22. In the embodiment, the amount of the fixing members 46, the first hollow fixing sleeves 40 and the second hollow fixing sleeves 42 are respectively four, four and four, and the two fixing members 46 are screws or bolts. The two angle regulators 32 are respectively arranged in the two protection cases 30 and respectively connected with the two connectors 26, and the two angle regulators 32 regulate an angle of the chair back 24 with respect to the chair seat 22 through the two connectors 26 and the two fixing sleeves 28. The pillow frame 38 is arranged on a top of the chair back 24. The seat cushion 34 is arranged on the chair seat 22 and wraps the chair seat 22 and the two protection cases 30. The back cushion 36 is arranged on the chair back 24 and wraps the chair back 24 and the pillow frame 38. Alternatively, the back cushion 36 wraps the fixing sleeves 28, the chair back 24 and the pillow frame 38. In the embodiment, the back cushion 36 wraps the fixing sleeves 28, the chair back 24 and the pillow frame 38, and the seat cushion 34 wraps the chair seat 22 and the two protection cases 30, thereby beautifying the appearance of the chair.

Figure 8:
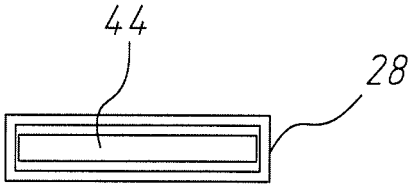
FIG. 8 is a top view of a fixing sleeve sleeving a connection portion according to an embodiment of the present invention.
Figure 9:
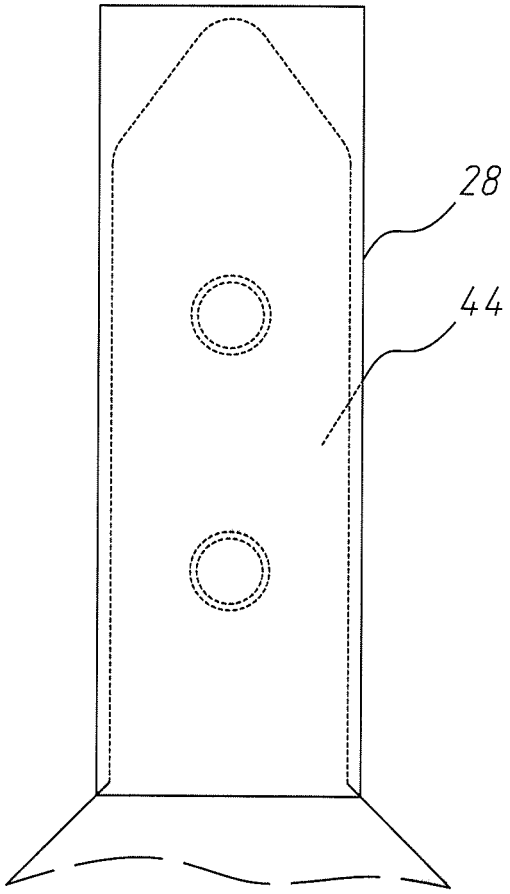
FIG. 9 is a diagram schematically showing the fixing sleeve sleeving the connection portion according to an embodiment of the present invention.

Each protection case 30 further comprises two protection subcases 48 fixed to each other, and each connector 26 is fixed between the two protection subcases 48 corresponded thereof. Each connection portion 44 has an upper part and a lower part, and the largest cross-section width of the upper part is less than the largest cross-section width of the lower part corresponded thereof to use the two lower parts to respectively abut against the two fixing sleeves 28. Thus, the position of the connection portion 44 in the fixing sleeve 28 is fixed. In the embodiment, the fixing sleeve 28 is exemplified by an enclosed ring sleeve, as shown in FIG. 8.

Each fixing sleeve 28 is further provided with at least one first hollow fixing sleeve 40 and at least one second hollow fixing sleeve 42. In the embodiment, each fixing sleeve 28 is provided with two first hollow fixing sleeves 40 and two second hollow fixing sleeves 42. The first hollow fixing sleeve 40 and the second hollow fixing sleeve 42 penetrate through the fixing sleeve 28 corresponded thereof. Each fixing member 46 sequentially penetrates through the first hollow fixing sleeve 40, the connection portion 44 and the second hollow fixing sleeve 42 corresponded thereof, so as to respectively fix the two fixing sleeves 28 to the two connection portions 44. Each fixing member 46 further comprises a front fixing portion 50, a middle fixing portion 52 and a rear fixing portion 54, and the middle fixing portion 52 is arranged between the front fixing portion 50 and the rear fixing portion 54 The largest cross-section diameters of the front fixing portion 50, the middle fixing portion 52 and the rear fixing portion 54 are sequentially decreased. The largest cross-section diameters of the middle fixing portion 52 and the rear fixing portion 54 respectively match the largest inner diameters of the second hollow fixing sleeve 42 and the first hollow fixing sleeve 40. The rear fixing portion 54 sequentially penetrates through the connection portion 44 and the second hollow fixing sleeve 42 corresponded thereof. The middle fixing portion 52 penetrates through the first hollow fixing sleeve 40 corresponded thereof. The front fixing portion 50 is arranged adjacent to the first hollow fixing sleeve 40 corresponded thereof.

Figure 6:
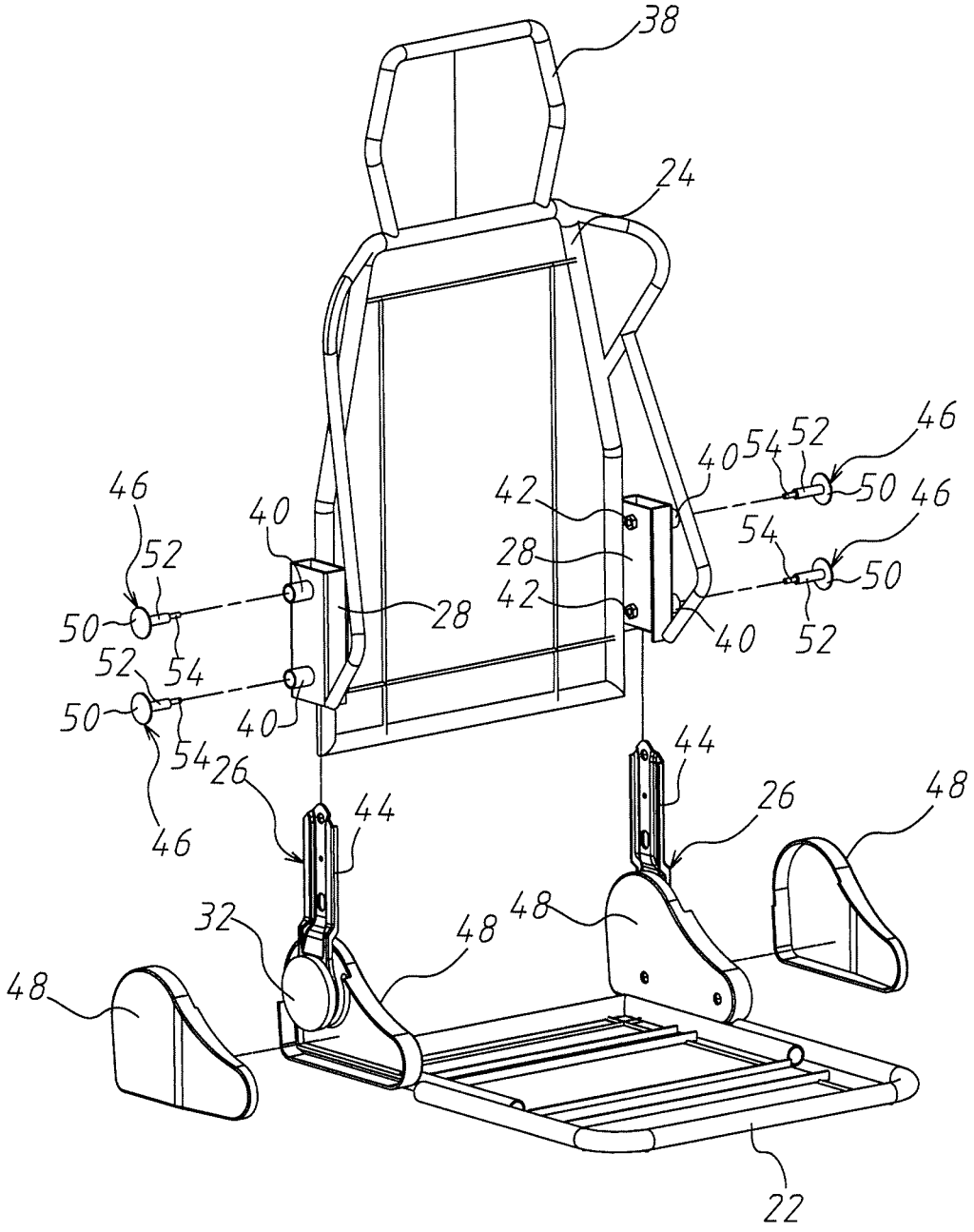
FIG. 6 is an exploded view of the assembled chair according to an embodiment of the present invention.
Figure 7:
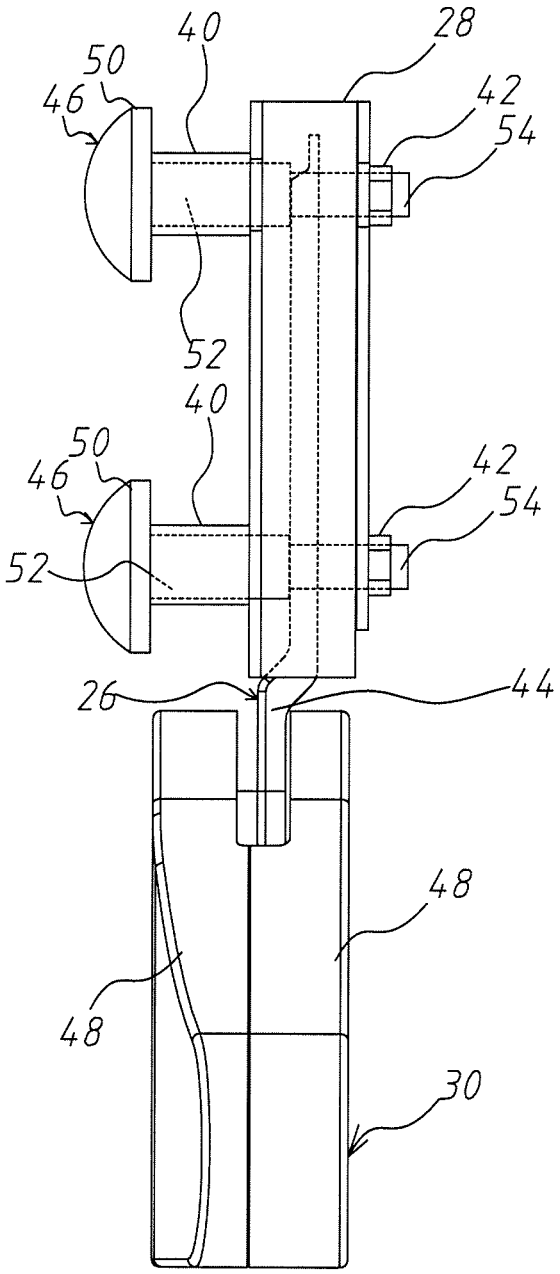
FIG. 7 is a diagram schematically showing a fixing member fixed to a fixing sleeve and a connection portion according to an embodiment of the present invention.
Figure 10:
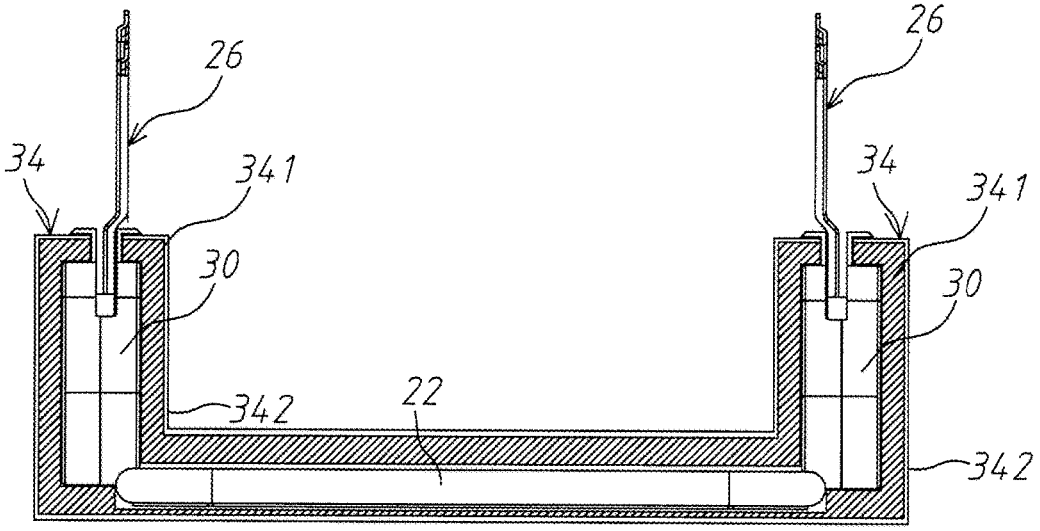
FIG. 10 is a sectional view of a chair seat, connectors, protection cases and a seat cushion according to an embodiment of the present invention.
Figure 11:
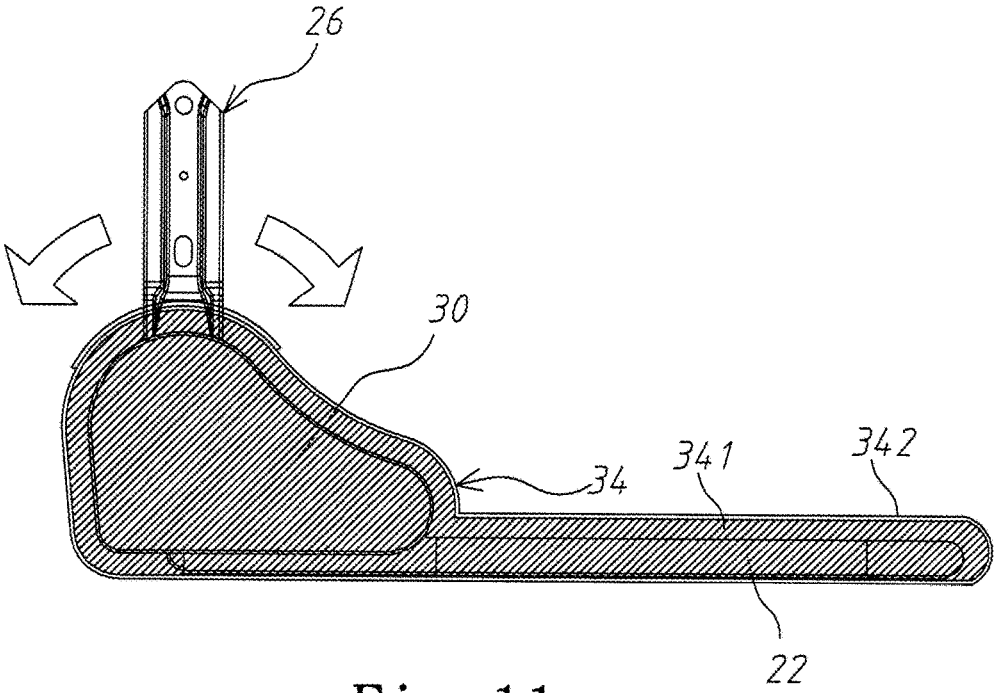
FIG. 11 is a side view of the chair seat, the connector, the protection case and the seat cushion according to an embodiment of the present invention.

Refer to FIG. 6, FIG. 10 and FIG. 11. Since the fixing sleeve 28 sleeves the connection portion 44 and the protection case 30 separates the connector 26 from the seat cushion 34, the connector 26 cannot directly connect with the seat cushion 34 and the back cushion 36. Thus, when the angle regulator 32 rotates the connector 26, the connector 26 will not destroy the seat cushion 34 and the back cushion 36, thereby improving the safety of the chair.

Figure 12:
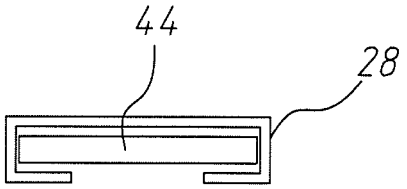
FIG. 12 is a top view of a fixing sleeve sleeving a connection portion according to an embodiment of the present invention.
Figure 13:
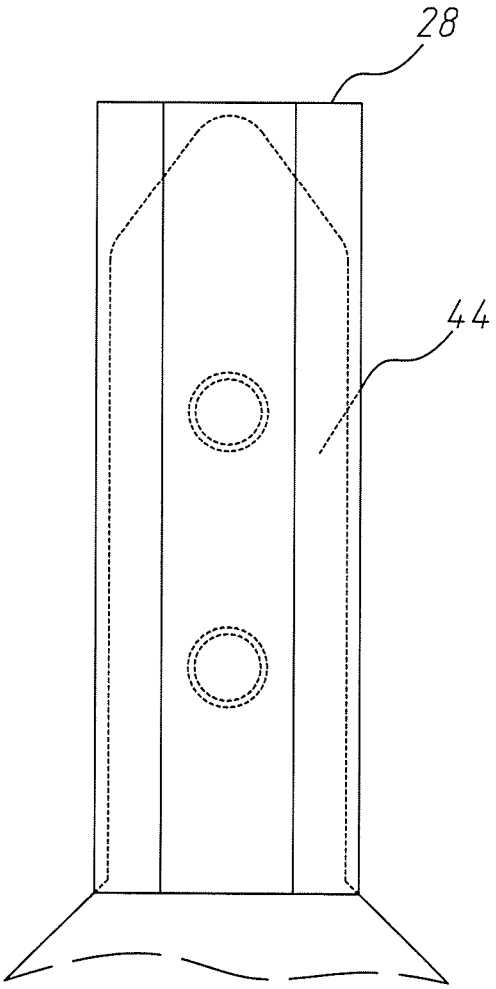
FIG. 13 is a diagram schematically showing the fixing sleeve sleeving the connection portion according to an embodiment of the present invention.
Figure 14:
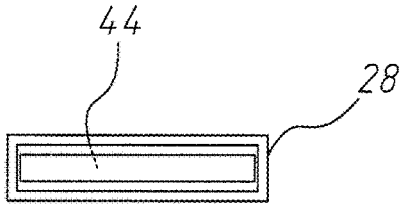
FIG. 14 is a top view of a fixing sleeve sleeving a connection portion according to an embodiment of the present invention.
Figure 15:
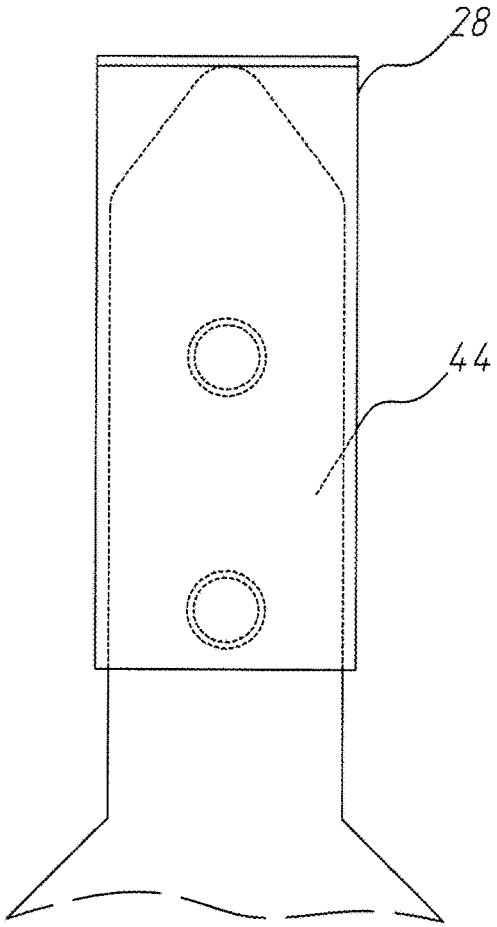
FIG. 15 is a diagram schematically showing the fixing sleeve sleeving the connection portion according to an embodiment of the present invention.

In the abovementioned embodiment, the fixing sleeve 28 of the present invention is realized with an enclosed ring sleeve. In addition, the fixing sleeve 28 is alternatively realized with non-enclosed ring sleeve, as shown in FIG. 12 and FIG. 13. Or otherwise, the two connection portions 44 respectively abut against the two fixing sleeves 28, so as to fix the position of the connection portions 44 in the fixing sleeve 28, as shown in FIG. 14 and FIG. 15.

In conclusion, the present invention uses the fixing sleeve to precisely sleeve the connector, so as to form a humanitarian auxiliary design and easily fix a chair back to a chair seat. Besides, the connector is wrapped in the protection case lest the connector touch a seat cushion to affect the safety.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. An assembled chair comprising:

a chair seat;

a chair back;

two connectors respectively having two connection portions;

two fixing sleeves respectively arranged at two opposite sides of said chair back; and two protection cases respectively fixed at two opposite sides of said chair seat, and said two connectors are respectively arranged in said two protection cases, and said two connection portions emerges from said two protection cases, and said two fixing sleeves respectively sleeve said two connection portions, and at least two fixing members are respectively fixed to said two connection portions, so as to fix said chair back to said chair seat;

wherein each said connection portion has an upper part and a lower part, and a largest cross-section width of said upper part is less than a largest cross-section width of said lower part corresponded thereof to use said two lower parts to respectively abut against said two fixing sleeves.

2. The assembled chair according to claim 1, further comprising two angle regulators respectively arranged in said two protection cases and respectively connected with said two connectors, and said two angle regulators regulate an angle of said chair back with respect to said chair seat through said two connectors and said two fixing sleeves.

3. The assembled chair according to claim 1, wherein each said protection case further comprises two protection subcases fixed to each other, and each said connector is fixed between said two protection subcases corresponded thereof.

4. The assembled chair according to claim 1, wherein said two connection portions respectively abut against said two fixing sleeves.

5. The assembled chair according to claim 1, wherein each said fixing sleeve is further provided with at least one first hollow fixing sleeve and at least one second hollow fixing sleeve, and said first hollow fixing sleeve and said second hollow fixing sleeve communicate to each other to penetrate through said fixing sleeve, and each said fixing member sequentially penetrates through said first hollow fixing sleeve, said connection portion and said second hollow fixing sleeve, so as to respectively fix said two fixing sleeves to said two connection portions.

6. The assembled chair according to claim 5, wherein each said fixing member further comprises a front fixing portion, a middle fixing portion and a rear fixing portion, and said middle fixing portion is arranged between said front fixing portion and said rear fixing portion, and largest cross-section diameters of said front fixing portion, said middle fixing portion and said rear fixing portion are sequentially decreased, and said largest cross-section diameters of said middle fixing portion and said rear fixing portion respectively match largest inner diameters of said second hollow fixing sleeve and said first hollow fixing sleeve, and said rear fixing portion sequentially penetrates through said connection portion and said second hollow fixing sleeve corresponded thereof, and said middle fixing portion penetrates through said first hollow fixing sleeve corresponded thereof, and said front fixing portion is arranged adjacent to said first hollow fixing sleeve corresponded thereof.

7. The assembled chair according to claim 1, further comprising a seat cushion arranged on said chair seat and wrapping said chair seat and said two protection cases.

8. The assembled chair according to claim 1, further comprising a back cushion arranged on said chair back and wrapping said chair back.

9. The assembled chair according to claim 8, wherein said back cushion further wraps said two fixing sleeves.

10. The assembled chair according to claim 8, further comprising a pillow frame arranged on a top of said chair back, and said back cushion further wraps said pillow frame.

11. The assembled chair according to claim 1, wherein said two fixing members are screws or bolts.

12. The assembled chair according to claim 1, wherein said two fixing sleeves and said chair back are integrally formed as a piece.

* * * * *